US009346522B2

(12) United States Patent
Ruosteinen et al.

(10) Patent No.: US 9,346,522 B2
(45) Date of Patent: May 24, 2016

(54) FRAME OF A WATER-JET PROPULSION UNIT FOR A BOAT, A WATER JET PROPULSION UNIT AND AN ARRANGEMENT IN A BOAT

(71) Applicant: Alamarin-Jet Oy, Härmä (FI)

(72) Inventors: Tuomas Ruosteinen, Vantaa (FI); Hannu Rantala, Ylihärmä (FI)

(73) Assignee: ALAMARIN-JET OY, Harma (FI)

( * ) Notice: Subject to any disclaimer, the term of this patent is extended or adjusted under 35 U.S.C. 154(b) by 0 days.

(21) Appl. No.: 14/430,888

(22) PCT Filed: Sep. 23, 2013

(86) PCT No.: PCT/FI2013/050915

§ 371 (c)(1),
(2) Date: Mar. 24, 2015

(87) PCT Pub. No.: WO2014/044917

PCT Pub. Date: Mar. 27, 2014

(65) Prior Publication Data

US 2015/0291263 A1 Oct. 15, 2015

(30) Foreign Application Priority Data

Sep. 24, 2012 (FI) ..... 20125984

(51) Int. Cl.

| | |
|---|---|
| ***B63H 11/08*** | (2006.01) |
| ***B63B 29/00*** | (2006.01) |
| ***B63B 3/70*** | (2006.01) |
| ***B63H 21/36*** | (2006.01) |

(52) U.S. Cl.

CPC . *B63B 29/00* (2013.01); *B63B 3/70* (2013.01); *B63H 11/08* (2013.01); *B63H 21/36* (2013.01)

(58) Field of Classification Search

CPC ..... B63B 29/00; B63H 11/08
USPC ..... 440/38
See application file for complete search history.

(56) References Cited

U.S. PATENT DOCUMENTS

| | | | | |
|---|---|---|---|---|
| 3,040,696 A * | 6/1962 | Dahle | B63H 11/08 | 415/72 |
| 5,522,742 A * | 6/1996 | Futaki | B63H 11/01 | 440/46 |
| 6,176,749 B1 * | 1/2001 | Kato | B63B 35/731 | 440/112 |

(Continued)

FOREIGN PATENT DOCUMENTS

JP 2002308183 A 10/2002

OTHER PUBLICATIONS

International Search Report of PCT/FI2013/050915 dated Feb. 14, 2014.

*Primary Examiner* — Lars A Olson
*Assistant Examiner* — Jovon Hayes
(74) *Attorney, Agent, or Firm* — FisherBroyles, LLP; Robert Kinberg

(57) ABSTRACT

A frame of a water jet propulsion unit arranged to be installed and sealed into an installation opening of a boat. The water-jet propulsion unit includes an impeller and the boat has a counter-sealing surface to which the frame is attached. The frame includes a flow channel to guide water to the impeller. The flow channel has a top with a maintenance opening. The maintenance opening is positioned to permit servicing the impeller. A first sealing surface forms a first closed loop to attach the water-jet propulsion unit tightly to the counter-sealing surface of the boat. A second sealing surface forms a second closed loop arranged to attach the water-jet propulsion unit to the boat. The first and second closed loops permit the maintenance opening of the frame to be alternatively locatable respectively outside or inside the stern of the boat in dependence on alternative configurations of the installation opening of the boat.

13 Claims, 13 Drawing Sheets

(56) References Cited

U.S. PATENT DOCUMENTS 6,475,044 B1 * 11/2002 Jones ..... B63H 11/08 440/38
7,270,583 B1 * 9/2007 Yeun-Junn ..... B63H 5/16 440/38
7,507,128 B2 * 3/2009 West ..... B63B 7/02 114/246
2009/0093174 A1 * 4/2009 Rui ..... B63B 35/7943 440/38
2015/0291263 A1 * 10/2015 Ruosteinen ..... B63H 11/08 440/38

* cited by examiner

FRAME OF A WATER-JET PROPULSION UNIT FOR A BOAT, A WATER JET PROPULSION UNIT AND AN ARRANGEMENT IN A BOAT

BACKGROUND

The present invention relates to a frame for a water-jet propulsion unit, which is arranged to be installed and sealed into an installation opening for a water-jet propulsion unit belonging to a boat, which frame includes

- a flow channel for guiding water to the impeller belonging to the water-jet propulsion unit,
- a maintenance opening located on top of the flow channel, for servicing the impeller, and
- a sealing surface forming a closed loop for attaching the water-jet propulsion unit tightly to a counter-sealing surface belonging to the boat.

The invention also relates to a corresponding water-jet unit equipped with a water-jet propulsion unit's frame, and an arrangement in a boat.

Water-jet propulsion units suck the water required for the water jet into a flow channel, in which the velocity of the water is increased with the aid of an impeller. Water-jet propulsion units are situated in such a way that the flow channel is located entirely or at least partially outside the boat. Garbage can easily enter the flow channel and wind itself around the impeller or other parts. For this reason, a separate maintenance opening, through which maintenance can be performed, is required for servicing the impeller and flow channel of the water-jet propulsion unit.

According to the wishes of customers, water-jet propulsion units are attached to a boat equipped with an attachment opening, in such a way that the maintenance opening is located either inside or outside the stern of the boat. A maintenance opening located inside facilitates maintenance directly from the boat, but on the other hand causes the risk of a leak if the maintenance opening leaks. A maintenance opening located outside does not have the risk of a leak, but on the other hand makes maintenance difficult to perform outside the stern of the boat. Publication U.S. Pat. No. 5,522,742 A discloses a boat, in which the water-jet propulsion unit is installed in such a way that the maintenance opening is situated inside the stern.

Due to the various ways of installing water-jet propulsion units, each form of installation requires a separate structure, either in the frame of the water-jet propulsion unit or in the boat. This, in turn, demands two separate models, depending on the manner of installation, from the manufacturers of the water-jet propulsion units or of boats or of both, which leads to increasing design costs.

SUMMARY OF THE INVENTION

The intention of the frame according to the invention for a water-jet propulsion unit is to create a frame, with the aid of which the same water-jet propulsion unit can be used in both forms of installation. The intention of the water-jet propulsion unit according to the invention is to create a water-jet propulsion unit, which same water-jet propulsion unit can be used in both forms of installation. Further, the intention of the arrangement according to the invention is to create an arrangement in a boat, in which the maintenance opening of the water-jet propulsion unit can be situated according to the wishes of the customer, either inside or outside relative to the stern of the boat.

The intention of the frame of the water-jet propulsion unit according to the invention can be achieved by means of a water-jet propulsion unit frame, which is arranged to be installed and sealed into a water-jet propulsion unit installation opening belonging to a boat. The frame includes a flow channel for guiding water to the impeller belonging to the water-jet propulsion unit, a maintenance opening situated on top of the flow channel for servicing the impeller, and a sealing surface forming a closed loop, for attaching the water-jet propulsion unit tightly to the counter sealing surface belonging to the boat. The frame includes, in addition, an additional sealing surface, for forming a second closed loop, which is arranged to be used in attaching the water-jet propulsion unit to the boat in such a way that the maintenance opening of the frame is situated alternatively either inside or outside the stern belonging to the boat. The alternative methods of installation can then be implemented using the same water-jet propulsion unit frame.

Preferably, the sealing surface includes two parts, that is, a first part and a second part, of which the second part is used alternatively relative to the additional sealing surface. This permits the frame to be sealed alternatively according to its use.

The first part can be used as an addition to the additional sealing surface in attaching the water-jet propulsion unit to the boat, in such a way that the maintenance opening is situated outside the stern belonging to the boat. This permits the frame to be sealed alternatively according to its use.

The second part of the sealing surface is used as an addition to the first part of the sealing surface when attaching the water-jet propulsion unit to the boat, in such a way that the maintenance opening of the frame is situated inside the stern belonging to the boat. With the aid of optional components, the alternative installation methods can be performed without changes to the frame of the water-jet propulsion unit.

Preferably, the closed loop formed by the additional sealing surface and the first part of the sealing surface is at least for part of the distance essentially the same as the closed loop formed by the first part and the second part of the sealing surface. In this case, the term essentially refers to the fact that the loops can be parallel to each other or completely the same. The loops branch when they are completely convergent for part of the distance.

According to one embodiment, the sealing surface is arranged to extend in a continuous form past the maintenance opening, as far as the exit opening belonging to the flow channel. The continuous sealing surface permits easier installation of the water-jet propulsion unit, depending on the dimensions of the boat.

The sealing surface can be at an angle relative to the axis, which is 10-60°, preferably 20-50°. The sealing surface can then be formed firmly on top of the flow channel.

The additional sealing surface can be at a distance from the sealing surface, which distance is 40-60 percent, preferably 45-55 percent of the length of the additional sealing surface. The engine of the water-jet propulsion unit will then be set at the correct height, when the installation of the water-jet propulsion unit is made in such a way that the maintenance opening remains outside the stern of the boat.

The intention of the water-jet propulsion unit according to the invention can be achieved by means of a water-jet propulsion unit, which includes a water-jet propulsion unit frame according to the invention.

The intention of the arrangement according to the invention can be achieved by means of an arrangement in a boat, in which the boat includes a hull and an installation opening for the water-jet propulsion unit belonging to the arrangement.

The water-jet propulsion unit includes a frame, which includes a flow channel for guiding water to the impeller belonging to the water-jet propulsion unit, a maintenance opening situated on top of the flow channel for servicing the impeller, and a sealing surface forming a closed loop for attaching the water-jet propulsion unit tightly to the counter sealing surface of the boat. The frame includes in addition an additional sealing surface for forming a second closed loop arranged to be used to attach the water-jet propulsion unit to the boat, in such a way that the maintenance opening of the frame is situated alternatively inside or outside the stern belonging to the boat. In such an arrangement, the location of the maintenance opening of the water-jet propulsion unit in the boat can be chosen according to the wishes of the customer.

Preferably, the boat further includes alternative installation pieces for sealing the installation opening of the boat. Thus, by only changing the installation pieces, the same frame can be attached to the boat according to the wishes of the customer.

Preferably, the boat's counter sealing surface is formed into a separate installation piece. Thus, the boat's installation opening can be effectively sealed, with no change to the frame of the water-jet propulsion unit.

Preferably, the boat includes a planar counter sealing surface, which facilitates sealing.

BRIEF DESCRIPTION OF THE DRAWINGS

In the following, the invention is described in detail with reference to the accompanying drawings depicting some embodiments of the invention, in which.

DETAILED DESCRIPTION

Figure 1A:
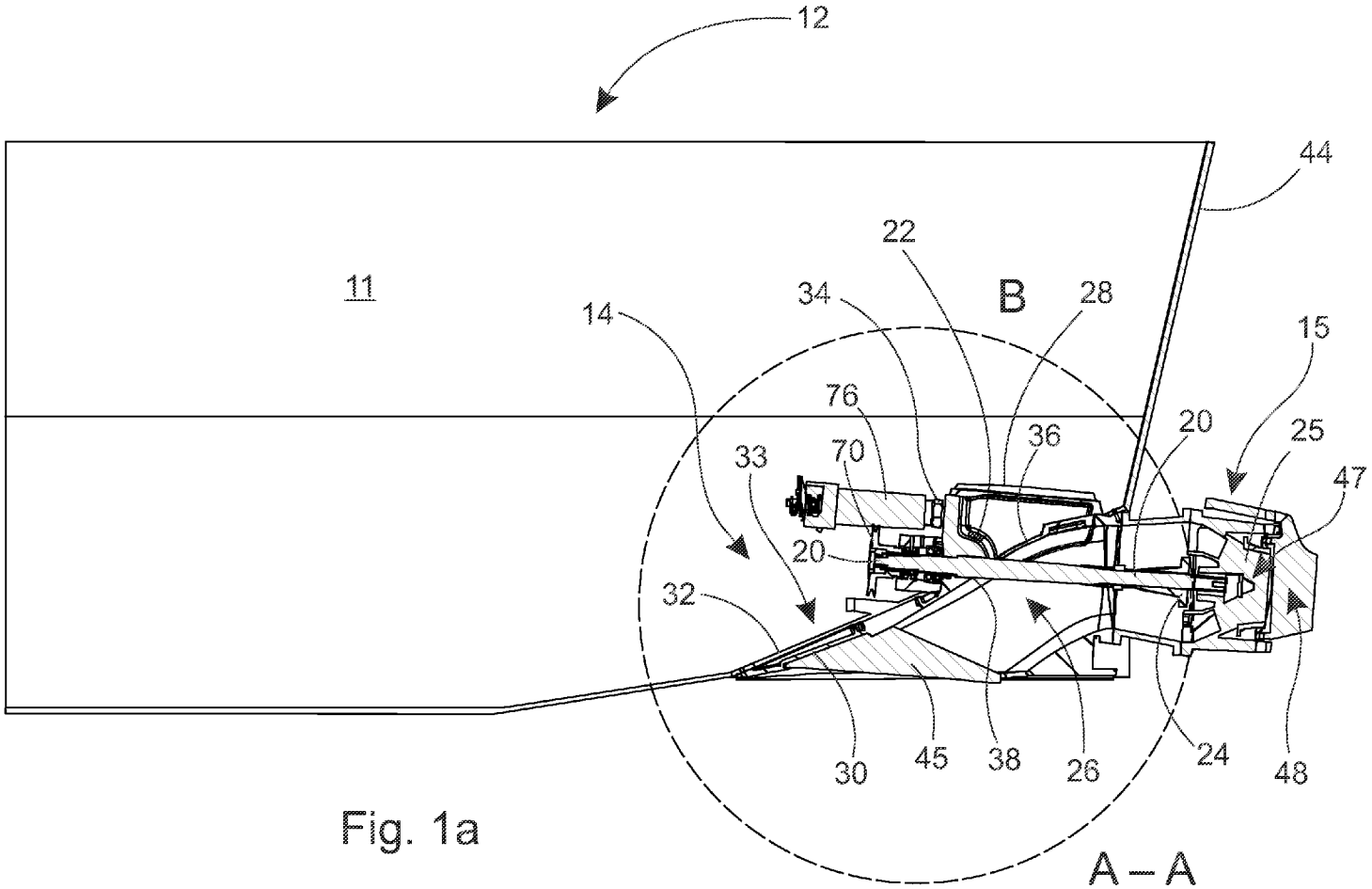
FIG. 1*a* shows a side view of a first embodiment of the arrangement according to the invention, in which the maintenance opening is inside the stern of the boat.
Figure 1B:
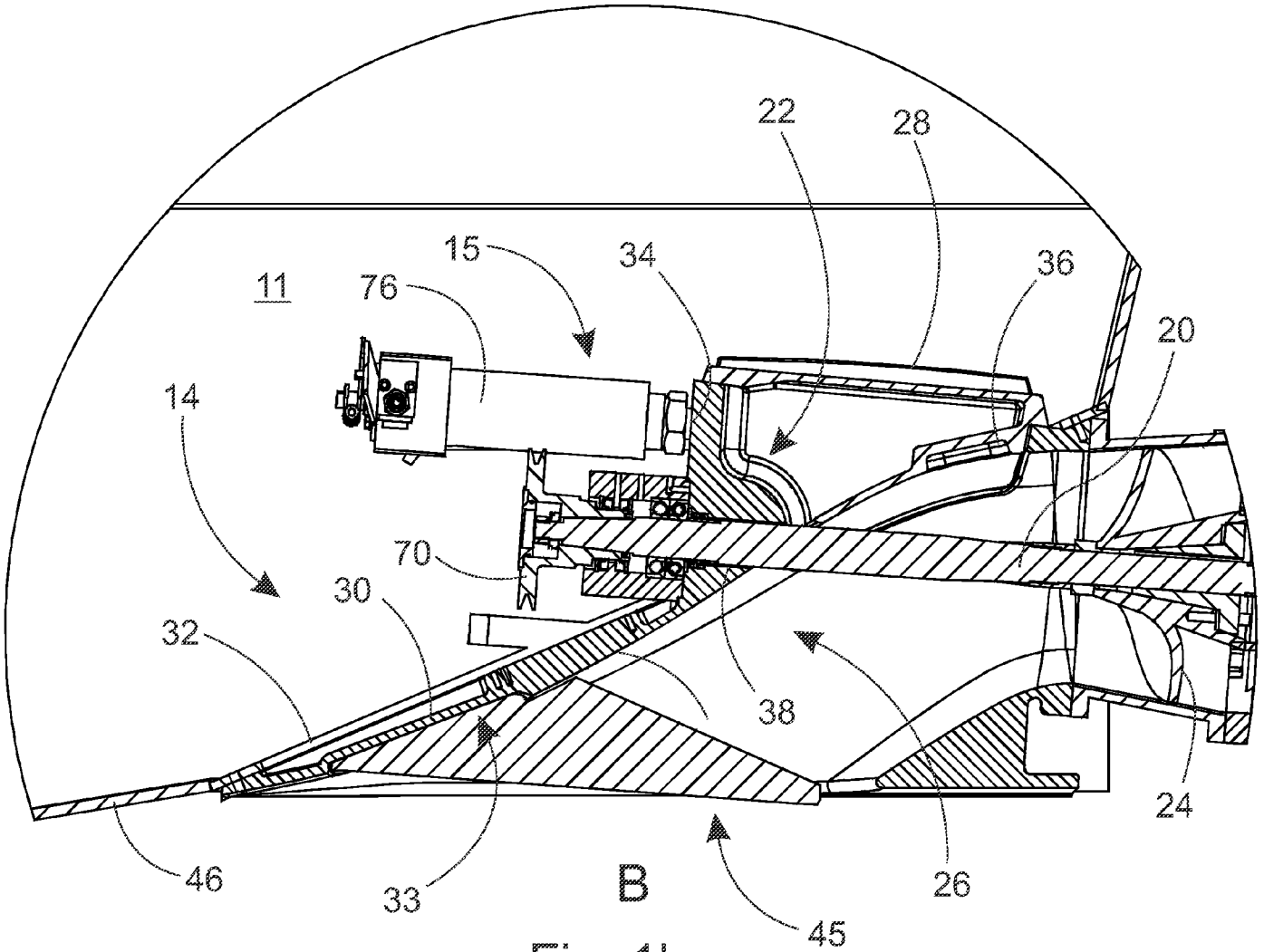
FIG. 1*b* shows an enlargement of FIG. 1*a*.
Figure 1C:
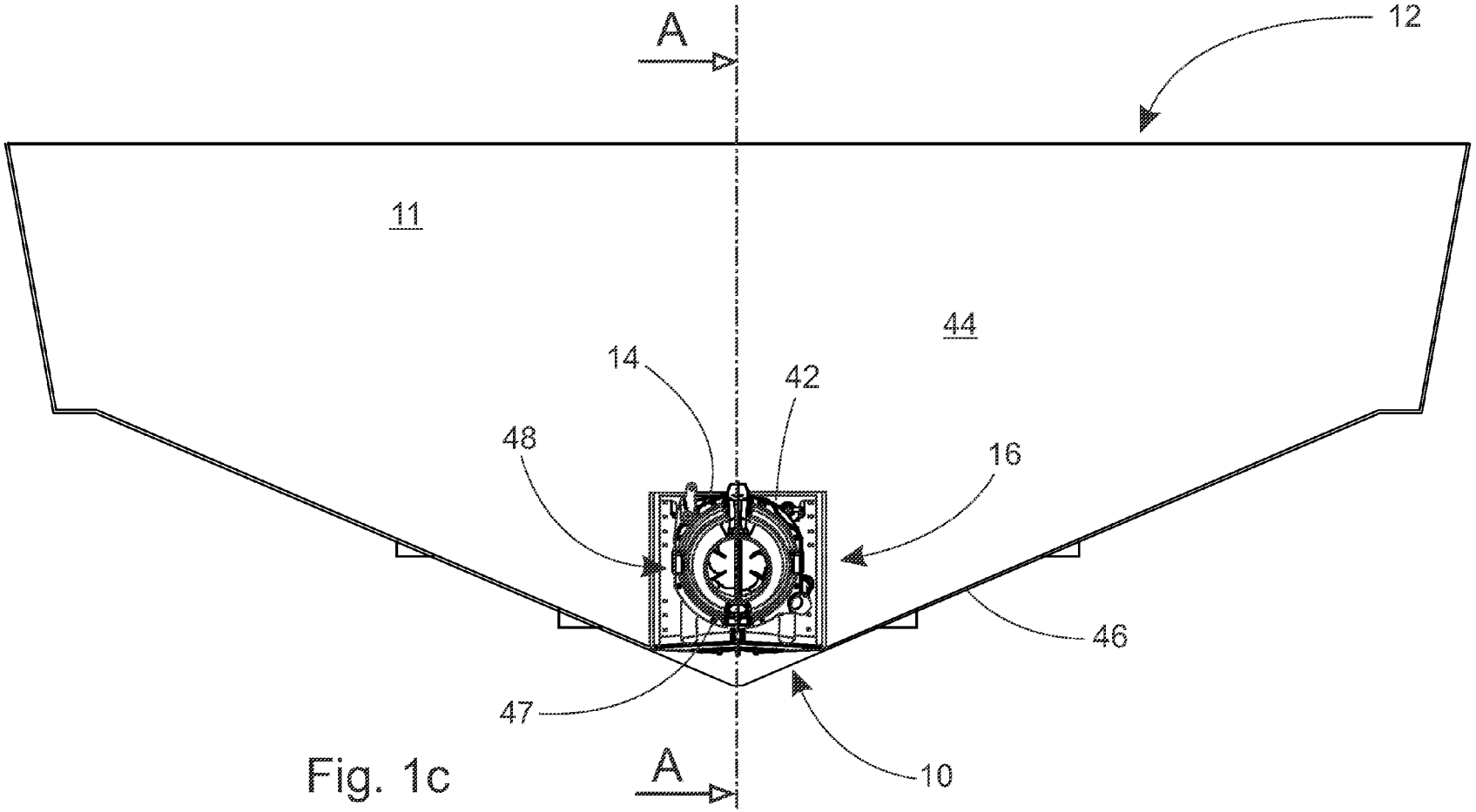
FIG. 1*c* shows a rear view of the embodiment according to FIG. 1*a*.

The frame of the water-jet propulsion unit, the water-jet propulsion unit, and the arrangement in a boat, according to FIGS. 1*a*-2*f*, relate to boats and to water-jet propulsion units attached to them. Hereinafter, the water-jet propulsion unit will be referred to by the term water jet. The arrangement 10 includes a boat 12 and a water jet 16. The boat 12 includes a hull 11 and is equipped with an installation opening 14 for a water jet 16, which is formed in the stern 44 and bottom 46 of the boat 12. The water jet 16 is sealed to the stern 44 and bottom 46 of the boat 12 with the aid of an installation piece 42, so that the boat 12 is once again watertight. The engine (not in the figures) driving the water jet is situated inside the boat, from where it is connected directly, with the aid of a shaft 20 and its coupling flange 70, to the water jet 16.

The water jet 16 consists of a frame 15, with the aid of which the water jet 16 is attached to the boat 12, and a nozzle part 48, by which the water jet of the water jet 16 is controlled and aimed. For control, the water jet 16 can include a hydraulic pump, which drives the control shaft 74 rotating the nozzle part 48. The frame 15 of the water jet 16 for its part includes a flow channel 26, a shaft support 22 and maintenance opening 28 on top of the flow channel 26, an impeller 24 (in FIG. 1*b*), a stator 25, and an annular sealing surface 33 forming a closed loop. In addition, the frame 15 includes an additional sealing surface 34, which form a second closed loop. The additional sealing surface 34 is preferably formed in the shaft support 22. The sealing surface 33 includes two parts, a first part 30 and a second part 36. The sealing surface 33 is at an angle of 10-60°, preferably 20-50°, relative to the shaft 20. The additional sealing surface 34 is preferably at right angles to the shaft 20. The sealing surface 33 and the additional sealing surface 34 are equipped with attachment holes (see FIG. 3), through which the frame 15 is attached to the counter sealing surface 32 in the boat 12, for example with the aid of bolts, screws, or similar attachment elements.

According to FIGS. 1*a*, 1*b*, 2*a*, 2*b*, and 3, the flow channel 26 is intended for taking water from the bottom of the boat and turning the flow in the longitudinal direction of the boat. For this purpose part of the flow channel 26 forms a slanting plane with the horizontal. The sealing surface 33 is formed on top of the flow channel 26. The sealing surface 33 of the frame 15 of the water jet 16 lies essentially in the direction of the evenly rising main part of the flow channel 26. The term the main part of the flow channel 26 refers to that part of the flow channel, which begins from as close as possible to the bow of the boat and continues at the same angle up to the part of the flow channel that curves to the horizontal. The second part 36 of the sealing surface is practically a continuation of the first part 30, as clearly shown in FIG. 3.

The flow channel 26 has an intake opening 45, from which it takes water in, and an exit opening 47, from which the water flow, accelerated with the aid of the impeller 24, exits from the flow channel 26. The impeller 24 is located in front of the exit opening 47. The impeller 24 is attached to the engine shaft 20, which in turn is taken, with the aid of a feed-through 38, through the wall of the flow channel 26. To make the shaft 20 sturdy, it is also supported by a vertical, plate-like shaft support 22, which is situated on top of the flow channel 26. The shaft 20 passes through the shaft support 22 and travels through the feed-through 38. The part of the shaft 20 remaining under the maintenance opening 28 is bounded by the boat's longitudinal walls, the flow channel 26, and the shaft support 22. There is direct access for servicing through the maintenance opening 28 to the shaft 20 and the impeller 24 attached to it.

Figure 1D:
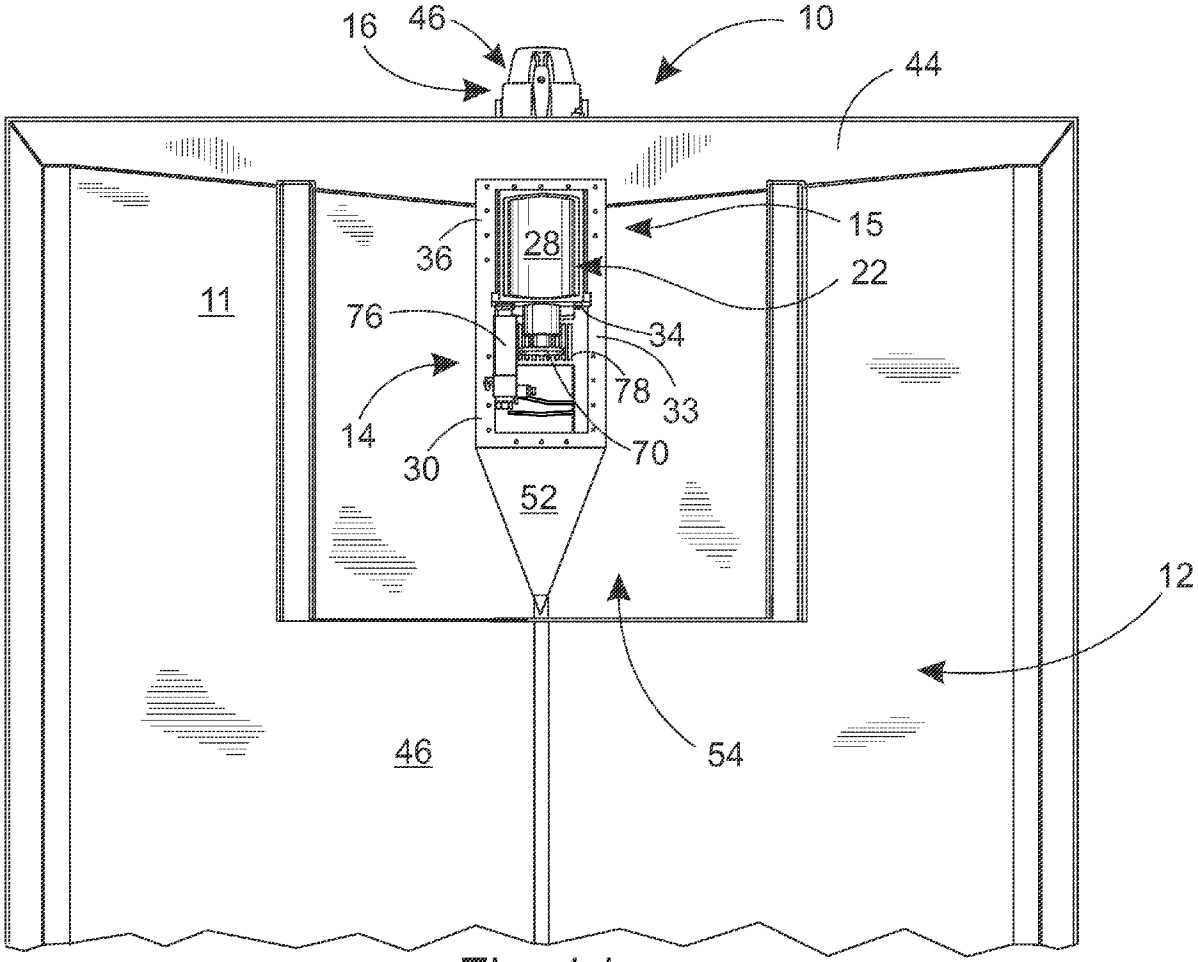
FIG. 1*d* shows a top view of the embodiment according to FIG. 1*a*.
Figure 1E:
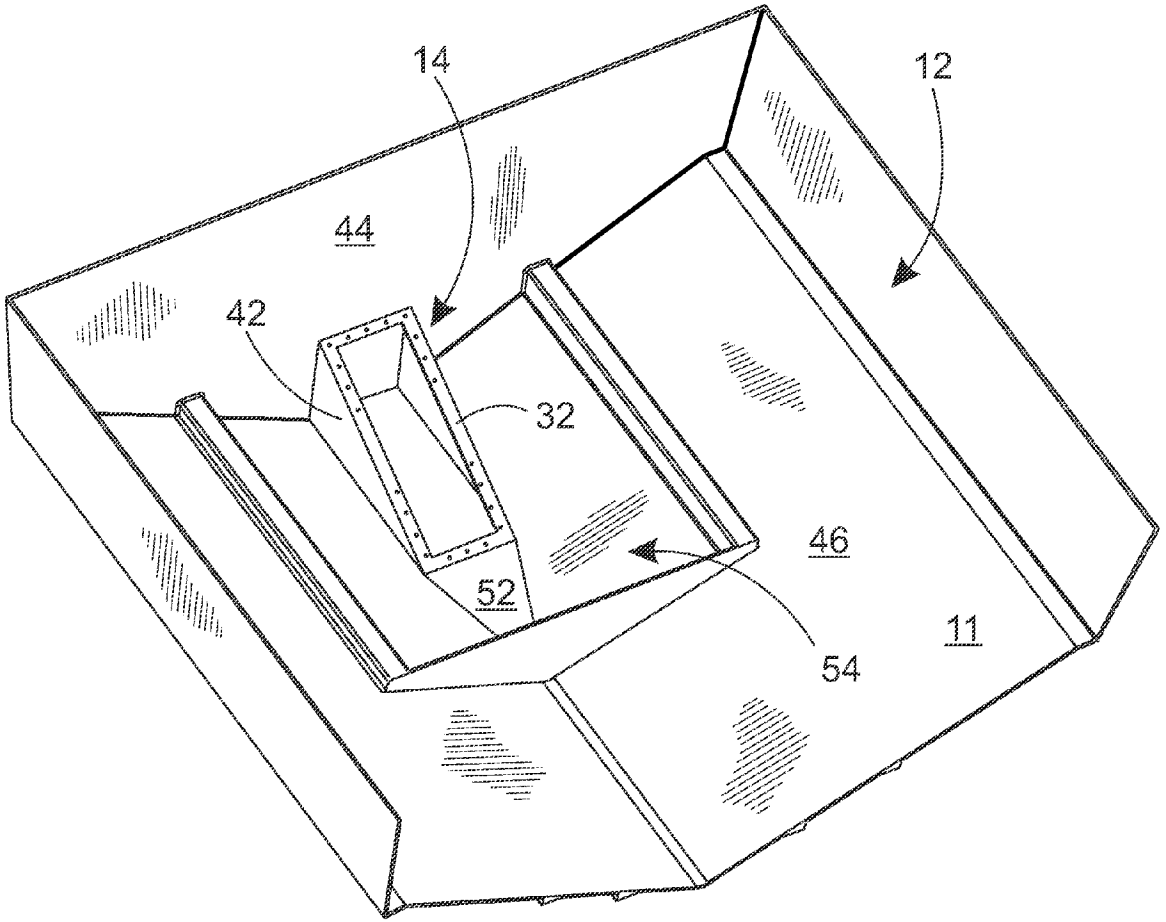
FIG. 1*e* shows an axonometric top view of the boat's installation opening, when an embodiment according to FIG. 1*a* of the arrangement according to the invention is used.
Figure 1F:
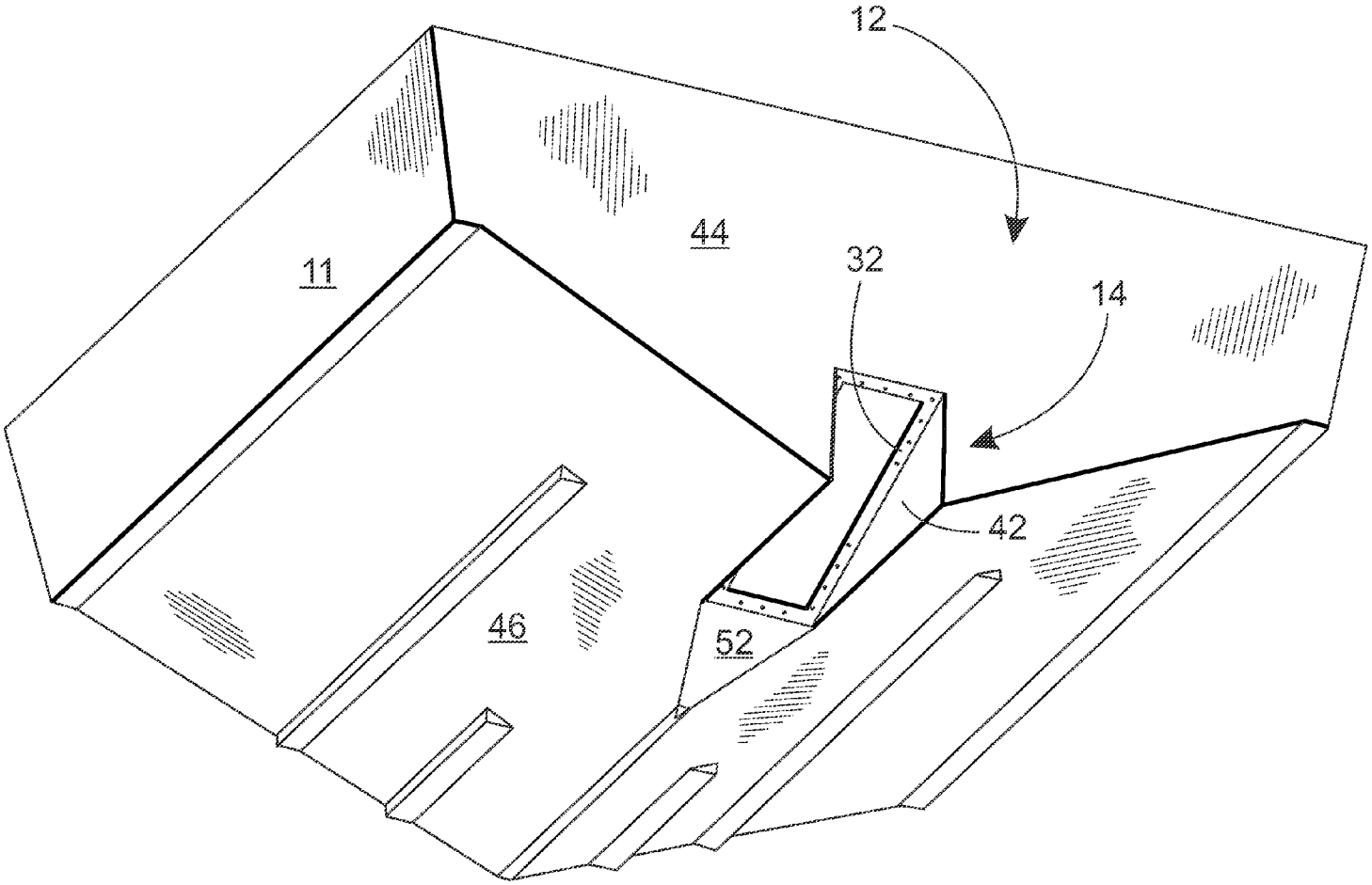
FIG. 1*f* shows an axonometric bottom view of the boat's installation opening, when an embodiment according to FIG. 1*a* of the arrangement according to the invention is used.
Figure 2A:
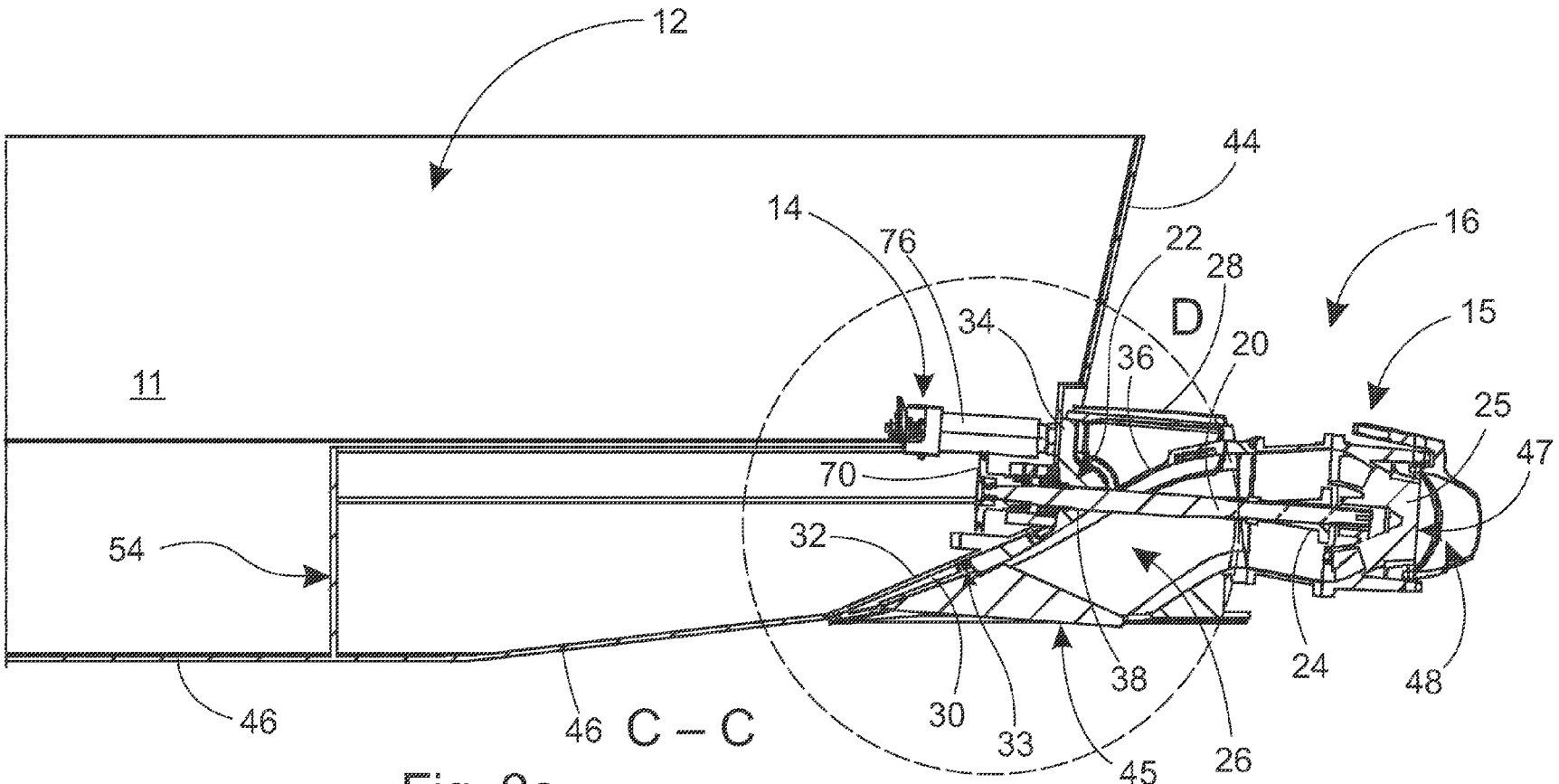
FIG. 2*a* shows a side view of one second embodiment of the arrangement according to the invention, in which the maintenance opening is outside the stern of the boat.
Figure 2B:
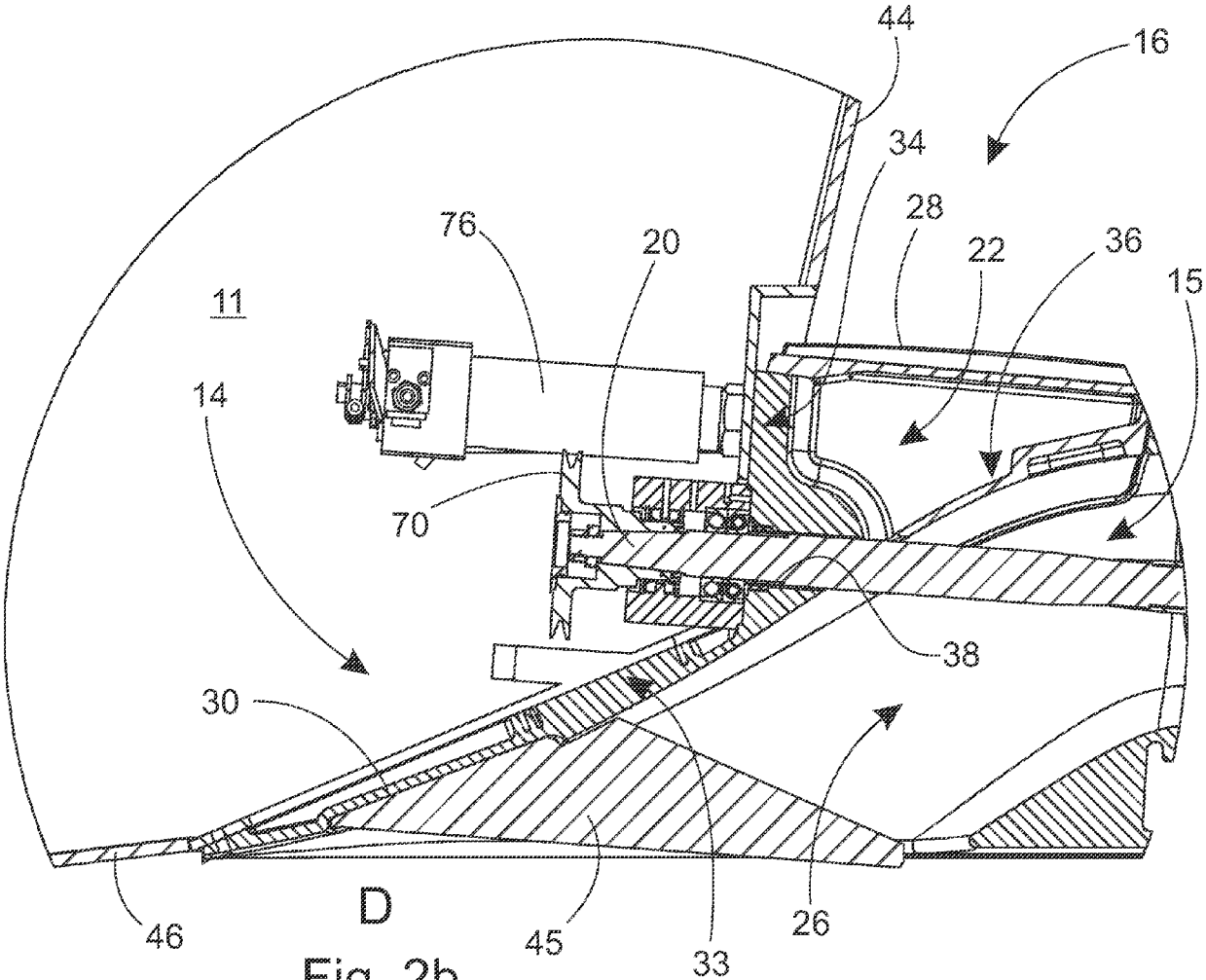
FIG. 2*b* shows an enlargement of FIG. 2*a*.
Figure 2C:
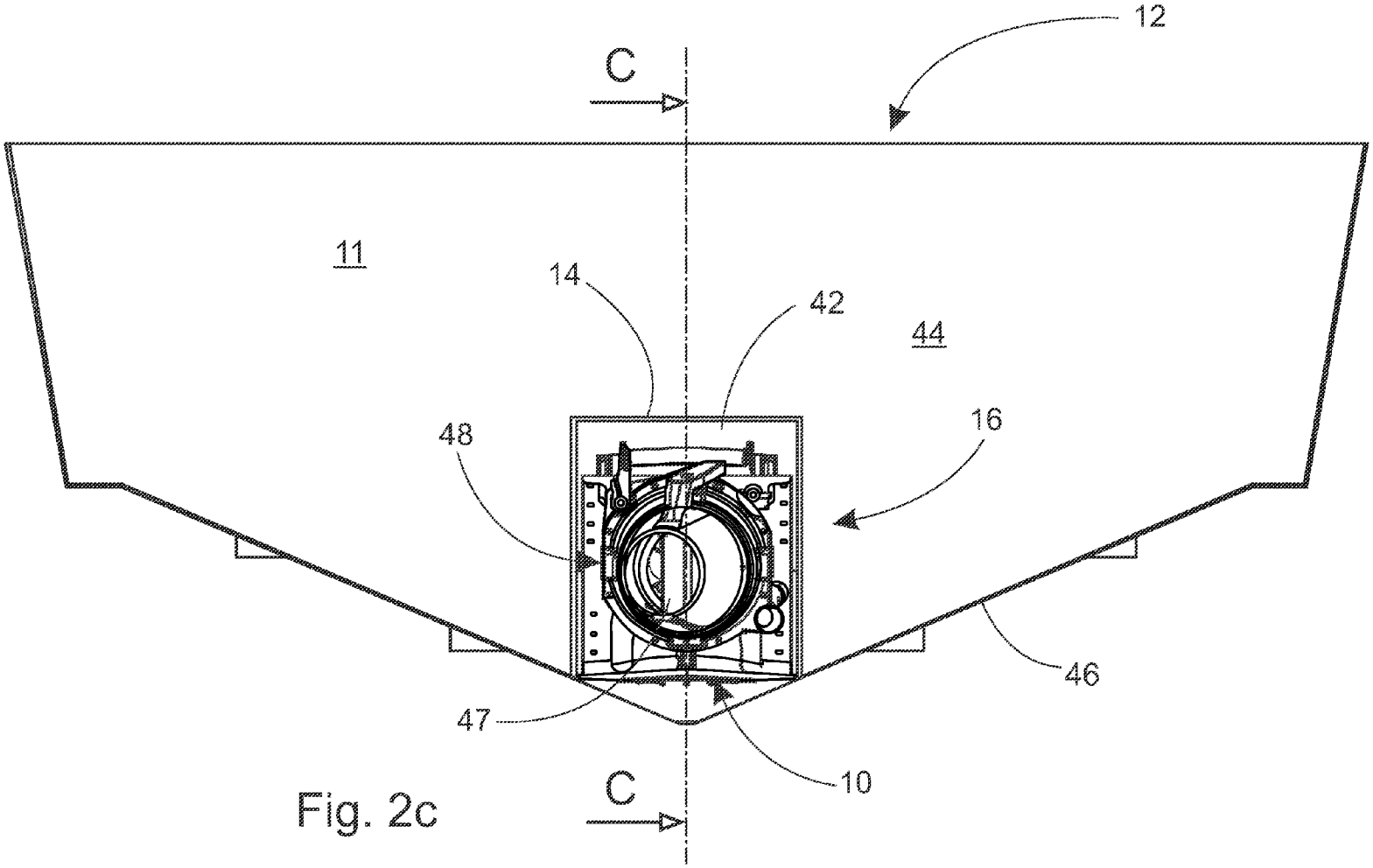
FIG. 2*c* shows a rear view of the embodiment according to FIG. 2*a*.
Figure 2D:
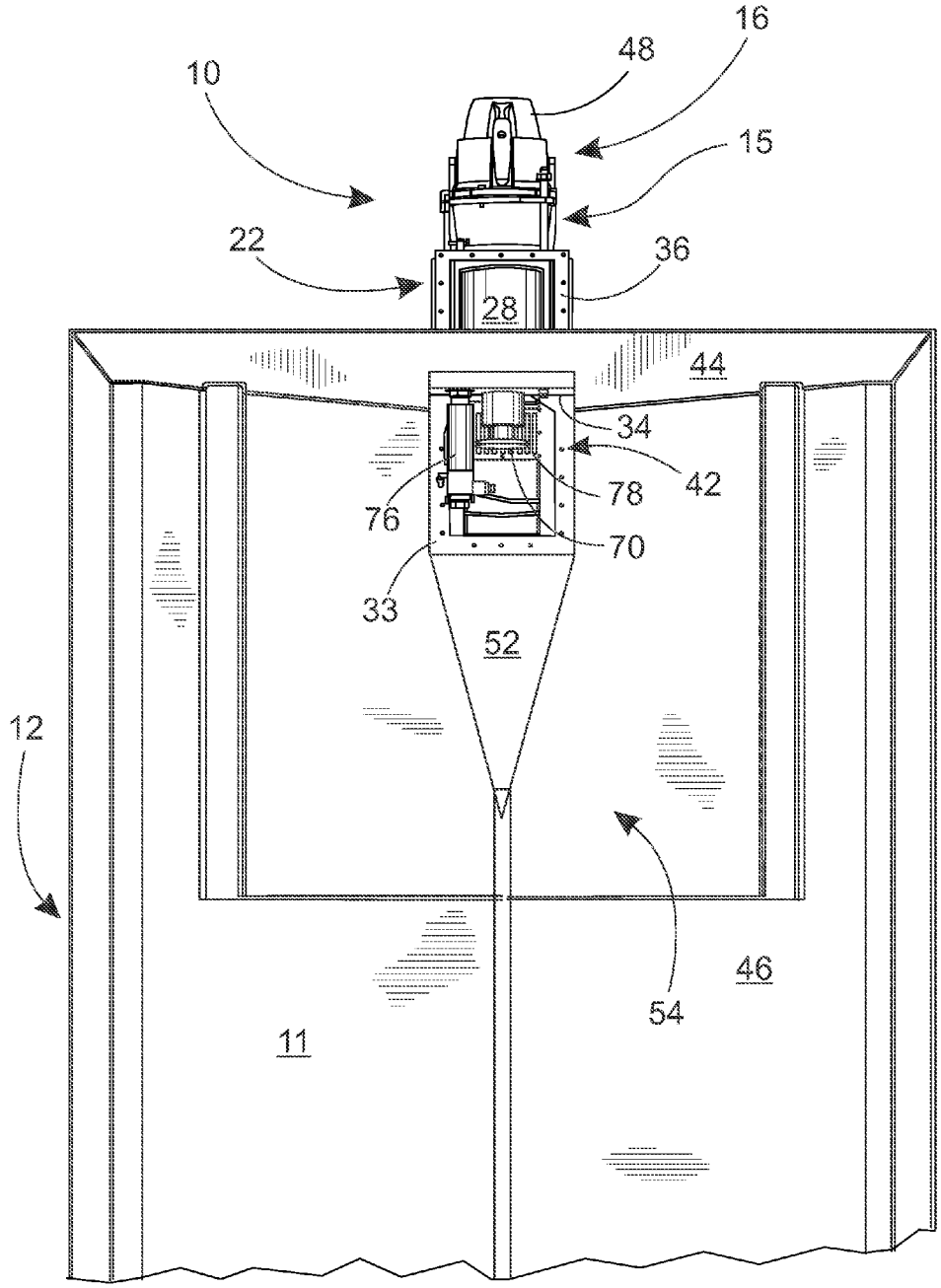
FIG. 2*d* shows a top view of the embodiment according to FIG. 2*a*.

According to FIGS. 1*d* and 2*d*, the bottom 46 of the boat 12 includes a bottom plate 52, to which the flow channel 26 of the water jet 16 is attached. The bottom plate 52 forms part of the bottom 46 of the boat 12 at the installation opening 14 of the boat 12. For installation, an installation opening corresponding to the chosen installation method should be made in the boat. Depending on the installation method, the maintenance opening is located in the installation either inside or outside the boat relative to the stern. In solutions according to the prior art, a special installation piece is used, with the aid of which the water jet is attached to the boat. In the arrangement according to the invention, an installation piece is also used, but the frame of the water jet is the same, irrespective of the installation method. The installation piece is intended to act as a counter sealing surface to the sealing surfaces of the frame of the water jet. In other words, the loop of the counter sealing surface of the boat is formed in the installation piece 42. According to FIGS. 1*e* and 2*e*, a vertical flange 54 can be made around the installation opening 14 of the boat 12, in which possible leakage water collects.

The sealing surface 33, the additional sealing surface 34, and the counter sealing surface 32 are preferably surfaces forming a loop, which can have a width of 3-15 cm, preferably 5-10 cm. At least the coupling flange 70 of the shaft 20, the cooler 78, and the operating cylinder 76 of the reversing scoop remain within these loops. If the frame 15 of the water jet 16 is installed in such a way that the maintenance opening 28 remains inside the boat 12 relative to the stern 44 of the boat 12, then the maintenance opening 28 also remains inside the loops of the sealing surface 33 and the counter sealing surface 32. Preferably, the surfaces used for sealing are smooth and treated for sealing.

FIGS. 1*a*-1*f* show an arrangement 10 according to a first embodiment of the arrangement according to the invention, in which the water jet 16 is installed in the boat 12 in such a way that the maintenance opening 28 remains inside the boat 12 relative to the stern 44 of the boat 12. In this embodiment, the frame 15 of the water jet 16 is attached and sealed to the boat 12 onto the counter sealing surface 32 of the boat 12, with the aid of the sealing surface 33. Because the second part 36 of the sealing surface 33 extends to the rear of the maintenance opening 28 on top of the flow channel 26, both the first part 30 and the second part 36 of the sealing surface 33 can be used for the attachment. In this embodiment, the additional sealing surface 34 remains inside the stern 44 of the boat 12. With the aid of the use of the sealing surface 33, the frame 15 of the water jet 16 can be attached to the counter sealing surface 32 of the boat 12 for the whole length of the flow channel 26. This makes the attachment of the water jet 16 to the boat 12 sufficiently strong.

FIGS. 2*a*-2*f* shown an arrangement 10 according to a second embodiment of the arrangement according to the invention, in which the water jet 16 is installed in the boat 12 in such a way that the maintenance opening 28 remains outside the boat 12 relative to the stern 44 of the boat 12. In this embodiment, the frame 15 of the water jet 16 is attached and sealed to the boat 12, onto the counter sealing surface 32 of the boat 12, with the aid of the additional sealing surface 34 and the first part 30 of the sealing surface 33. Because the maintenance opening 28 is on top of the flow channel 26, only the first part 30 of the sealing surface 33 extending to the shaft support 22 can be used for the attachment, the second part 36 not being available for attachment. In this embodiment, the second part 36 of the sealing surface 33 remains outside the boat 12 relative to the stern 44 of the boat 12. The additional sealing surface 34 is attached to the counter sealing surface 32 of the installation piece 42, parallel to the stern 44 of the boat 12. Thus in its entirety, the surface area available for sealing is nearly as large as in the embodiment according to FIGS. 1*a*-1*f*.

In the embodiments of FIGS. 1*a*-2*f*, the sealing surface 33 can be formed as a plate attached to the frame 15 of the water jet 16 on top of the flow channel 26. The plate is preferably of a corresponding width to the counter sealing surfaces 32 fitted to the installation opening 14 of the boat 12. Further, the plate is preferably parallel to the counter sealing surfaces, so that the attachment is made tight. The sealing surface is situated on top of the flow channel, so that it can be a unified plate structure, which ensures a strong construction. Special sealing adhesives, for example silicon or similar, can be used as an aid in the sealing.

Figure 2E:
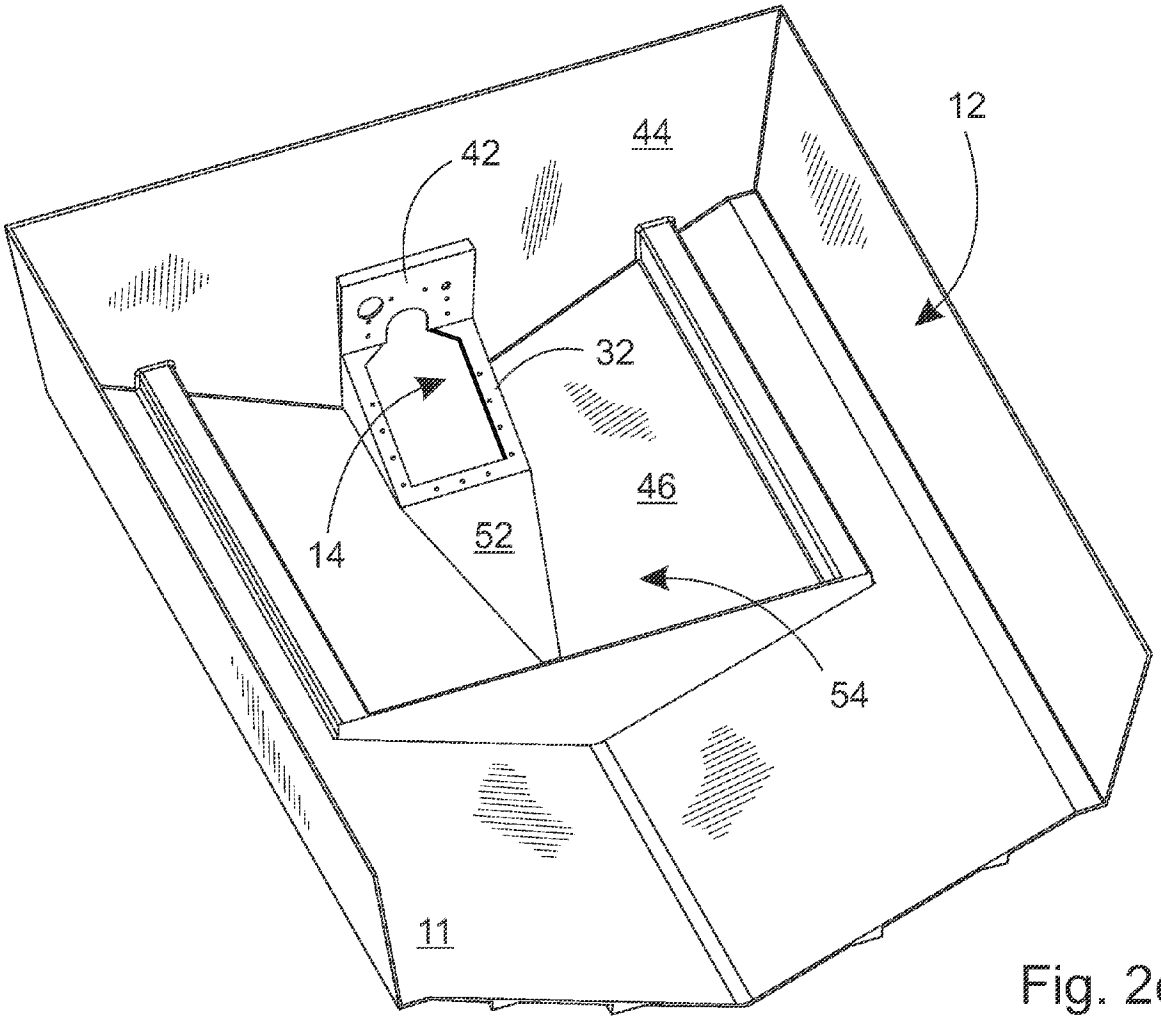
FIG. 2*e* shows an axonometric top view of the boat's installation opening, when a second embodiment of the arrangement according to the invention is used.
Figure 2F:
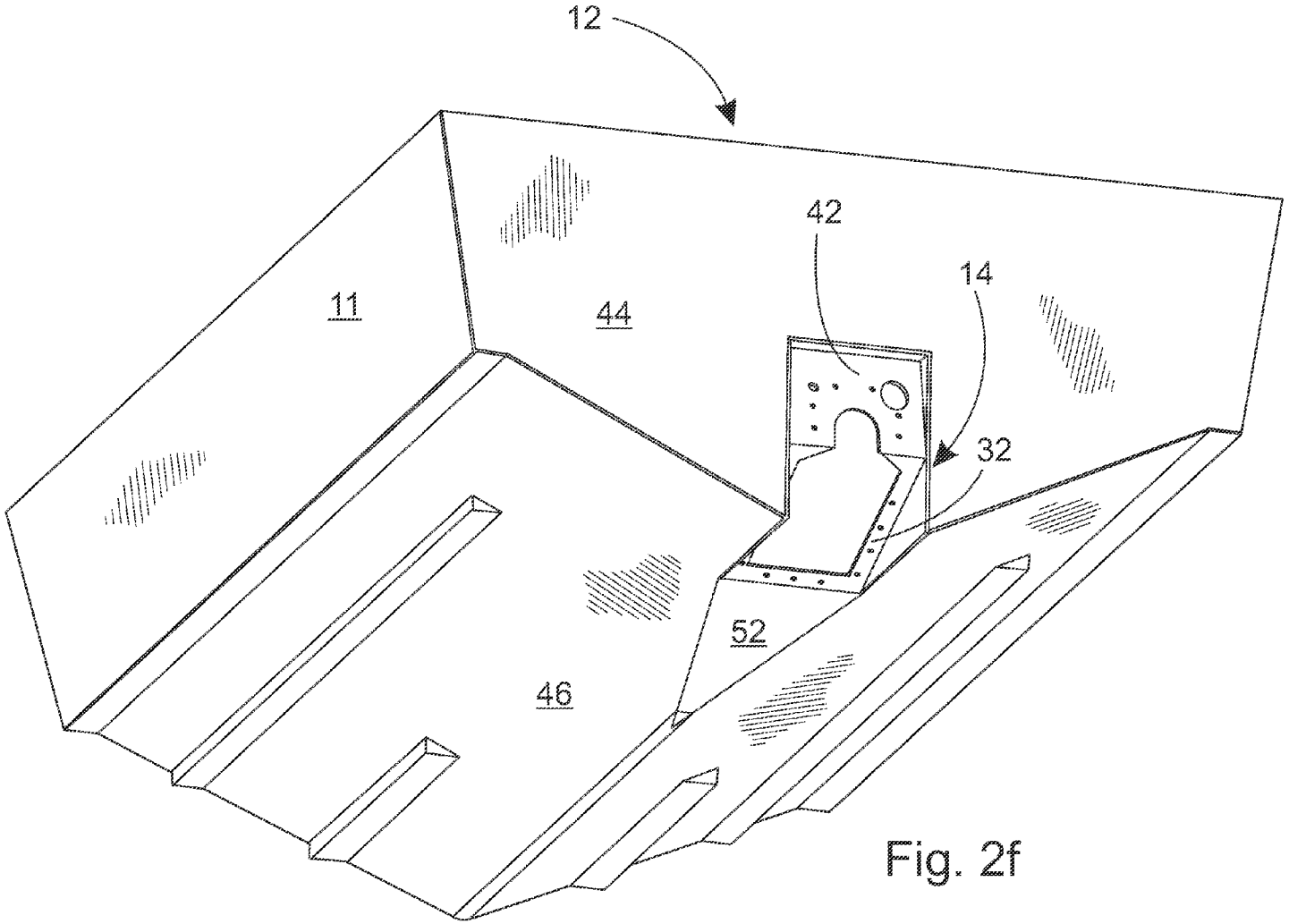
FIG. 2*f* shows an axonometric bottom view of the boat's installation opening, when a second embodiment of the arrangement according to the invention is used.

According to FIGS. 1*e* and 2*e*, the counter sealing surface 32 is a planar component forming a loop, which includes installation holes for the attachment of the frame of the jet. The sealing surface and the additional sealing surface are also corresponding loops. When the water jet is installed in such a way that the maintenance opening is placed inside relative to the stern of the boat, the corresponding loop of the loop of the counter sealing surface is formed by the first part and the second part of the sealing surface. On the other hand, when the jet is installed in such a way that the maintenance opening is placed outside relative to the stern of the boat, the loop corresponding to the loop of the counter sealing surface is formed by the first part of the sealing surface and the additional sealing surface. The loops of both installation methods can be partly in common, but they can also be loops entirely separate from each other. In addition to the first part of the sealing surface, the loop of the counter sealing surface is formed either from the additional sealing surface or from the second part of the sealing surface. In other words, the loop branches after the first part of the sealing surface to either the additional sealing surface or the second part of the sealing surface.

The frame 15 of the water jet according to the invention can be used in installations, in which the maintenance opening is alternatively inside or outside the stern of the boat. The alternative additional sealing surfaces ensure in both installation methods a sufficient sealing and attachment surface area for achieving qualitatively excellent sealing and attachment. By means of the arrangement according to the invention, the need to manufacture several different frames for a water jet can also be avoided, as now a single frame can be used in different installation methods. Only the installation piece acting as a counter sealing surface in the boats or part of the mould of the frame should be a component designed especially for each installation method. Alternative detachable parts can be designed for the hull of a reinforced plastic boat, by means of which a frame suitable for different installation methods can be obtained from the same basic mould.

The frame of the water jet according to the invention can be made by casting from aluminium, or some other corresponding material, which is sufficiently resistant in strength and corrosion resistant.

Figure 3:
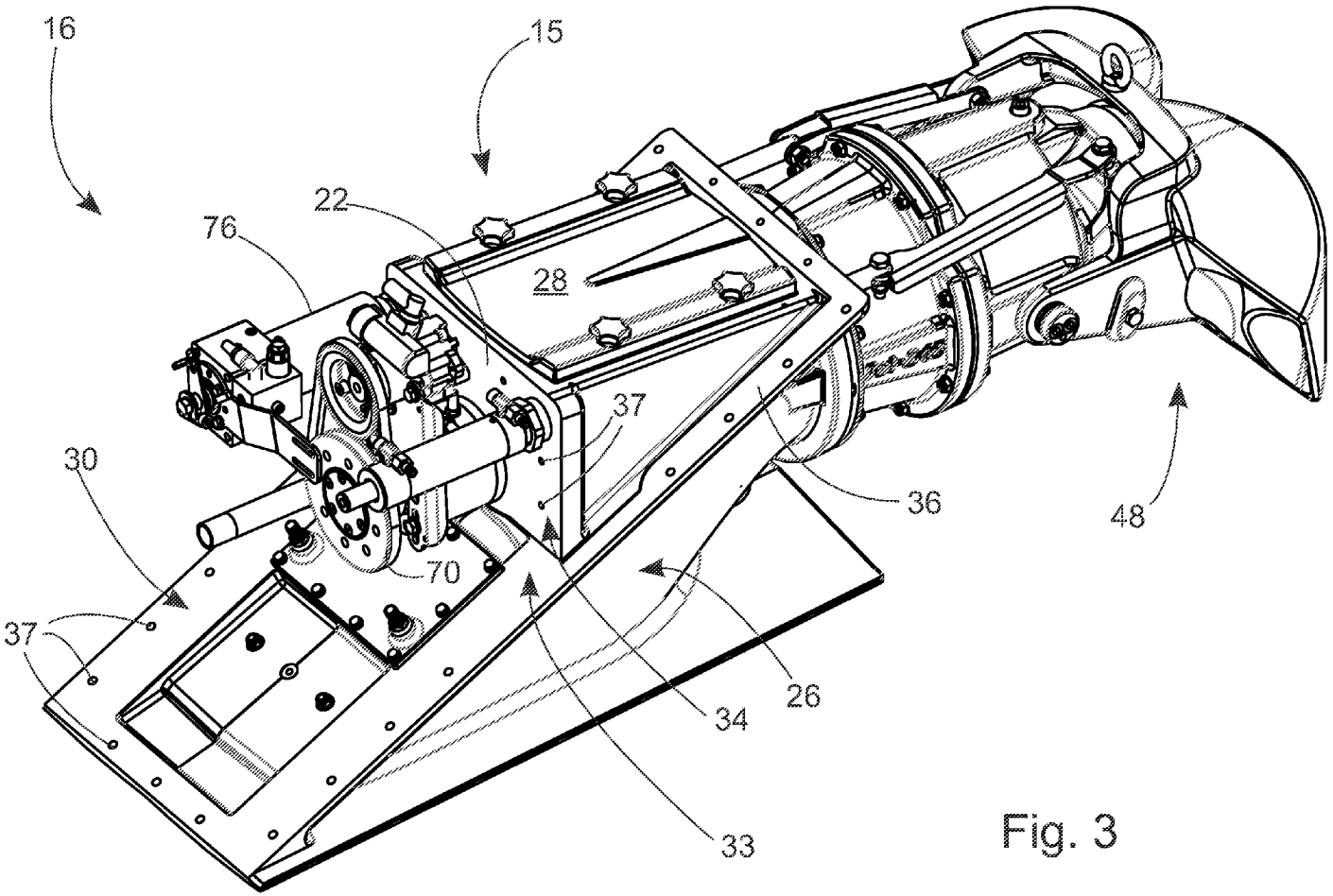
FIG. 3 shows an axonometric view of the frame of the water-jet propulsion unit.

In the arrangement according to the invention according to FIG. 3, the sealing of the water-jet propulsion unit can be formed in two alternative ways with the aid of two closed loops, in such a way that the closed loop is formed either by the first part 30 and the second part 36 of the sealing surface 33, or alternatively by the first part 30 of the sealing surface 33 and the additional sealing surface 34. It should be noted that FIG. 3 shows the structure of the water-jet propulsion unit in greater detail than in FIGS. 1*a*-2*f*, in which a simplified construction is shown.

In this connection, the term boat refers widely to watercraft, to which the water-jet propulsion device is suited.

The invention claimed is:

1. A frame of a water jet propulsion unit arranged to be installed and sealed into an installation opening of a boat, the water-jet propulsion unit including an impeller and the boat having a counter-sealing surface to which the frame is attached, the frame comprising:

a flow channel to guide water to the impeller, the flow channel having a top with a maintenance opening, the maintenance opening being positioned to permit servicing the impeller;

a first sealing surface to form a first closed loop to attach the water-jet propulsion unit tightly to the counter-sealing surface of the boat; and a second sealing surface to form a second closed loop arranged to attach the water-jet propulsion unit to the boat, wherein the first and second closed loops permit the maintenance opening of the frame to be alternatively locatable, respectively, outside or inside the stern of the boat in dependence on alternative configurations of the installation opening of the boat.

2. The frame according to claim 1, wherein the first sealing surface includes a first part and a second part, the second part being used alternatively relative to the second sealing surface.

3. The frame according to claim 2, wherein the first part is adapted for use in combination with the second sealing surface to form the second closed loop to attach the water-jet propulsion unit to the boat so that the maintenance opening of the frame is situated inside the stern of the boat.

4. The frame according to claim 2, wherein the second part is adapted for use with the first part to form the first closed loop to attach the water-jet propulsion unit to the boat so that the maintenance opening of the frame is situated outside the stern of the boat.

5. The frame according to claim 2, wherein the second closed loop formed by the second sealing surface and first part of the first sealing surface has a portion in common with the first closed loop formed by the first and second parts of the first sealing surface.

6. The frame according to claim 1, wherein the first sealing surface extends continuously past the maintenance opening up to an exit opening of the flow channel.

7. The frame according to claim 1, wherein the water jet propulsion unit includes a shaft that is connectable to a motor inside the boat, and wherein the first sealing surface is at an angle of 10°-60° relative to the shaft.

8. The frame according to claim 1, wherein the first sealing surface is on a circumference of the frame.

9. The frame according to claim 1, wherein first sealing surface has a length, and the second sealing surface is situated at a distance from an end of the first sealing surface, the distance being 40%-60% of the length of the first sealing surface.

10. A water-jet propulsion unit comprising a frame according to claim 1.

11. An arrangement comprising: the frame according to claim 1; the water jet propulsion unit comprising the frame; and the boat, the boat having a hull containing the installation opening; wherein the water-jet propulsion unit is for installation in the installation opening of the boat with the use of the frame.

12. The arrangement according to claim 11, wherein the boat comprises alternative installation pieces to seal the installation opening of the boat.

13. The arrangement according to claim 12, wherein the counter-sealing surface comprises alternative counter-sealing surfaces associated respectively with the alternative installation pieces.

* * * * *